US007617853B2

(12) United States Patent
Lehman

(10) Patent No.: US 7,617,853 B2
(45) Date of Patent: Nov. 17, 2009

(54) GOLF CLUB HEAD PROTECTIVE CAP

(76) Inventor: Tim Lehman, 28911 Jaeger Dr., Laguna Niguel, CA (US) 92677

( * ) Notice: Subject to any disclaimer, the term of this patent is extended or adjusted under 35 U.S.C. 154(b) by 168 days.

(21) Appl. No.: 11/998,489

(22) Filed: Nov. 30, 2007

(65) Prior Publication Data

US 2009/0139619 A1 Jun. 4, 2009

(51) Int. Cl.
*A63B 57/00* (2006.01)

(52) U.S. Cl. ..... 150/160; 150/154; 206/315.2; 206/315.4; 473/256

(58) Field of Classification Search ..... 150/160, 150/154; 206/315.2, 315.4; 473/256
See application file for complete search history.

(56) References Cited

U.S. PATENT DOCUMENTS 2,116,655 A * 5/1938 Berrittella ..... 473/231
5,615,720 A * 4/1997 O'Sullivan ..... 150/160
5,735,327 A * 4/1998 Aldcroft et al. ..... 150/160
5,997,411 A * 12/1999 Holub ..... 473/282
6,065,516 A * 5/2000 Chang ..... 150/160
6,260,250 B1 * 7/2001 Hall et al. ..... 29/281.1
6,419,591 B1 * 7/2002 Addeo et al. ..... 473/256
6,716,111 B2 * 4/2004 Liberatore ..... 473/256
7,344,450 B2 * 3/2008 Billings ..... 473/324
7,361,097 B2 * 4/2008 Hot ..... 473/256
2002/0124920 A1 * 9/2002 Noyes ..... 150/160
2007/0178989 A1 * 8/2007 Wright et al. ..... 473/342

* cited by examiner

*Primary Examiner*—Anthony D Stashick
*Assistant Examiner*—Cynthia F Collado
(74) *Attorney, Agent, or Firm*—Lynn & Lynn

(57) ABSTRACT

The protective cap for a golf club head comprises a thin-walled shell having a convex outer surface and a concave inner surface. The thin-walled shell preferably has an opening at an end portion thereof for receiving a shaft portion of the golf club with the portion of the golf club head to be protected being enclosed by the thin-walled shell. The thin-walled shell has at least one projection having an end extending away from the concave inner surface. An adhesive is applied to the end of the projection, which is formed such that the adhesive contacts a portion of the golf club head when the shaft extends through the opening to retain the protective cap mounted to a selected portion of the golf club head.

2 Claims, 4 Drawing Sheets

GOLF CLUB HEAD PROTECTIVE CAP

This invention relates generally to protecting merchandise on display for sale from being damaged and particularly to a protective cap that may be placed on an article to prevent it from becoming damaged by contact with other similar articles. Still more particularly, this invention relates to a removable cap that may be placed on a golf club head so that it is protected from damage while on display for retail sale.

Golf clubs displayed for retail sale are typically placed in vertical bins or horizontal racks with the heads extending outward so as to be visible to a shopper. The club heads may become damaged when clubs are removed from, or added to the bins. The result is that over a period of time, clubs that have been on display cannot be sold as being new because of the used appearance caused by contact with other objects.

SUMMARY OF THE INVENTION

The present invention provides a protective cap that prevents damage to golf clubs on display without preventing a shopper from seeing the features of golf clubs having the protective cap mounted thereto. The protective cap is transparent, easy to mount to a golf club head and is reusable.

A protective cap according to the present invention configured for mounting to a golf club to protect the golf club head from damage comprises a thin-walled shell having a convex outer surface and a concave inner surface. The thin-walled shell preferably has an opening at an end portion thereof for receiving a shaft portion of the golf club with the portion of the golf club head to be protected being enclosed by the thin-walled shell. The thin-walled shell has at least one projection having an end extending away from the concave inner surface. An adhesive is applied to the end of the projection, which is formed such that the adhesive contacts a portion of the golf club head when the shaft extends through the opening to retain the protective cap mounted to a selected portion of the golf club head.

The protective cap according to the present invention preferably includes a plurality of projections having ends with adhesive portions arranged to contact the golf club head.

The features and advantages of the invention may be better understood by referring to the accompanying drawings. It should be understood that the protective cap shown in the drawings is not drawn to any scale and is not configured for any specific golf club.

DETAILED DESCRIPTION OF THE INVENTION

Figure 1:
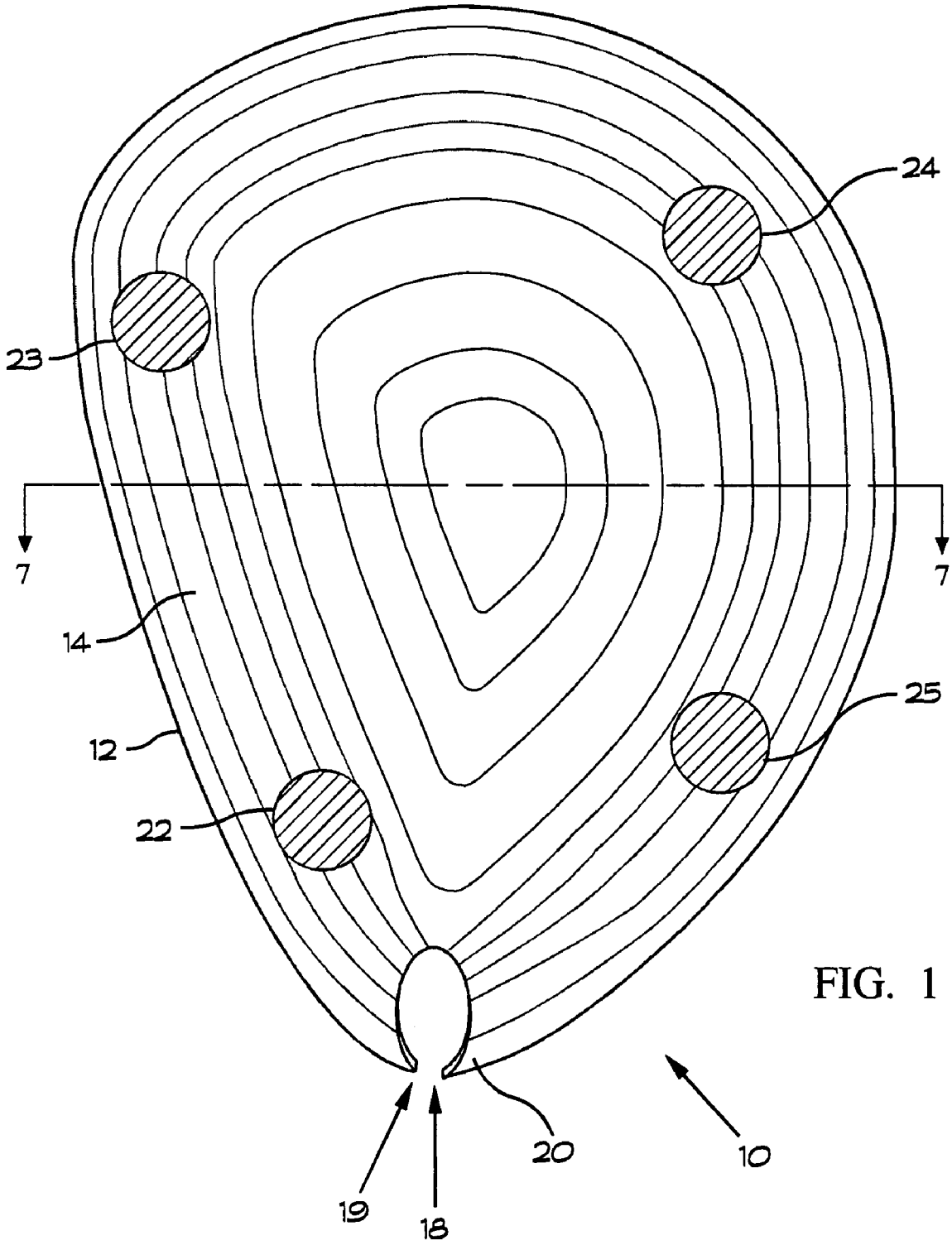
FIG. 1 is a top plan view of a golf club head protective cap according to the present invention.
Figure 3:
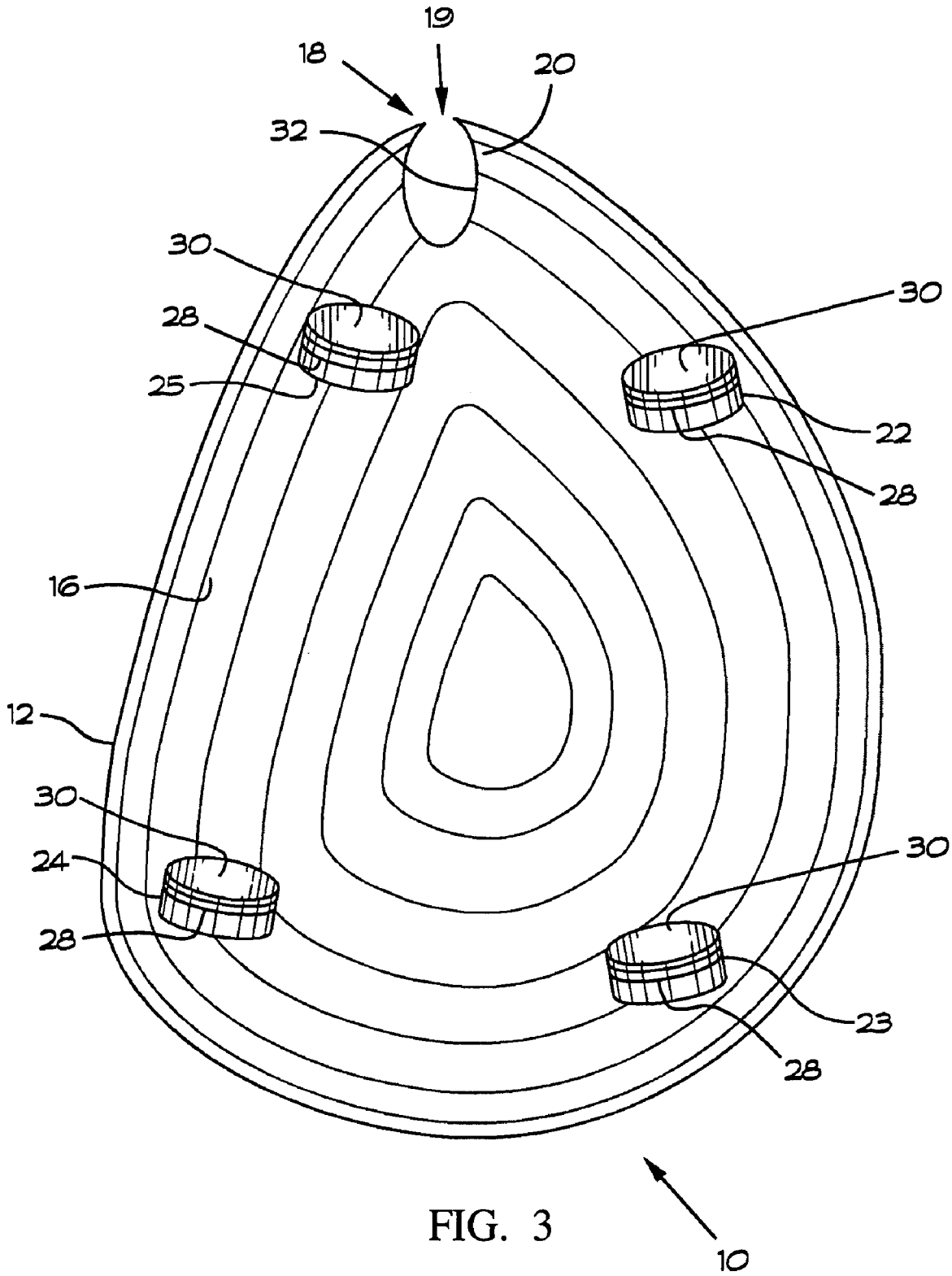
FIG. 3 is a perspective view showing the bottom side of the golf club head protective cap of FIGS. 1 and 2
Figure 4:
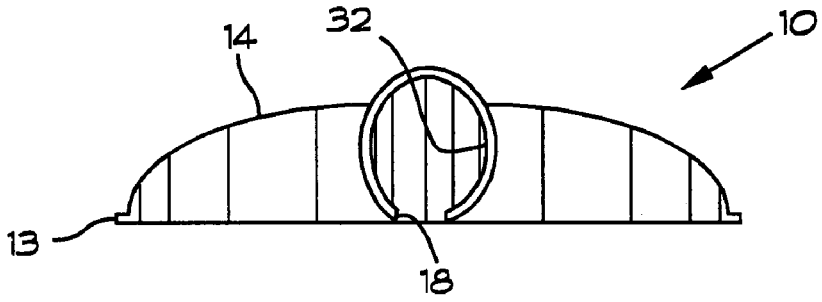
FIG. 4 is a front elevation view of the golf club head protective cap according to the present invention.
Figure 5:
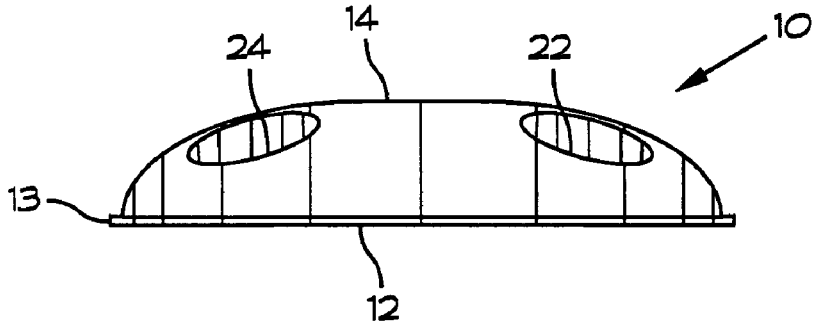
FIG. 5 is a rear elevation view of the golf club head protective cap according to the present invention.
Figure 6:
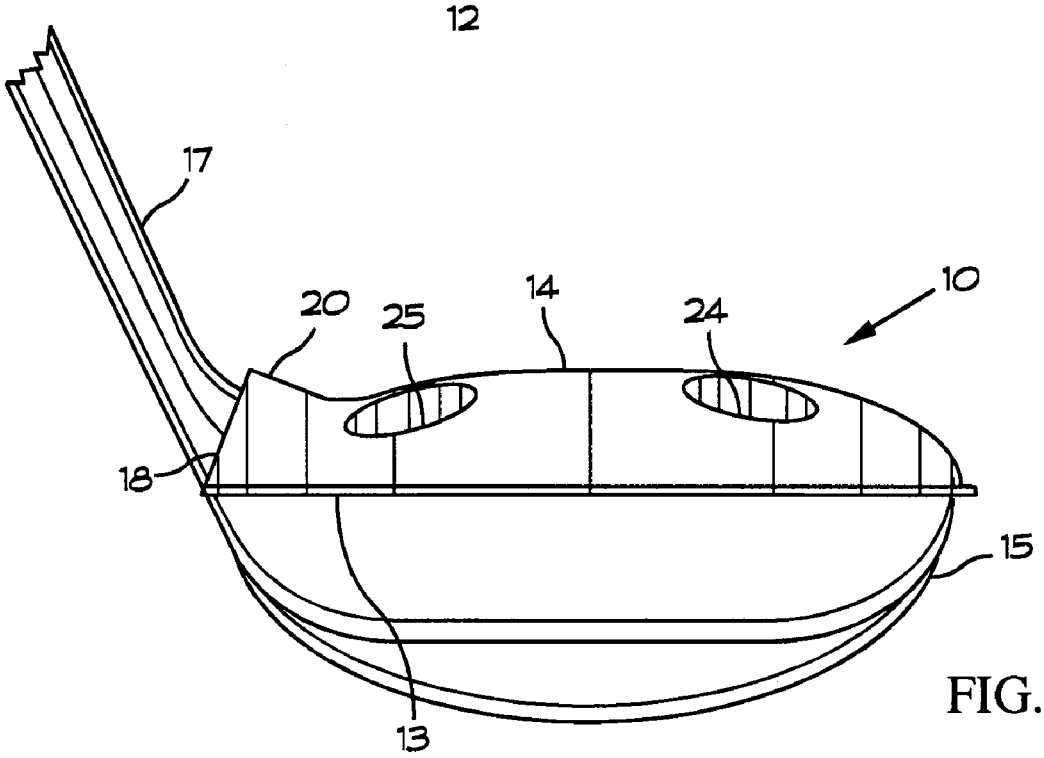
FIG. 6 is a right side elevation view of the golf club head protective cap according to the present invention.
Figure 7:
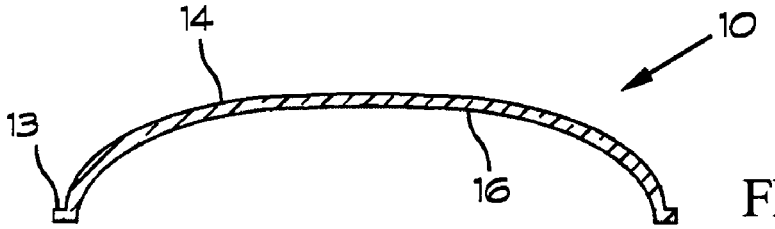
FIG. 7 is a cross sectional view along line 7-7 of FIG. 1.

FIG. 1 shows a golf club head protective cap 10 according to the present invention. The golf club head protective cap 10 preferably is formed by a molding process using clear polyethylene resins. Other similar materials may be used to form the golf club head protective cap 10. The golf club head protective cap 10 is formed to have a perimeter 12 that corresponds to that of typical drivers and fairway metal clubs (not shown). The perimeter 12 may have a flanged portion 13 as shown in FIGS. 4-6. The perimeter 12 and the flange 13 preferably generally define a plane. Referring to FIGS. 1-7, the golf club head protective cap 10 is molded to have a convexly curved outer surface 14 and a concave inner surface 16. The general shape of the golf club head protective cap 10 may be understood to resemble a half shell that is formed to enclose a portion of a golf club head 15 as shown in FIG. 6.

Referring to FIGS. 1-4 and 6, an opening 18 is formed at an end 20 of the golf club head protective cap 10. The opening 18 is formed to receive the lower portion of a golf club shaft 17 (FIG. 6). There is a small gap 19 in the perimeter 12 that allows the shaft 17 to be easily inserted into the opening 18.

Figure 2:
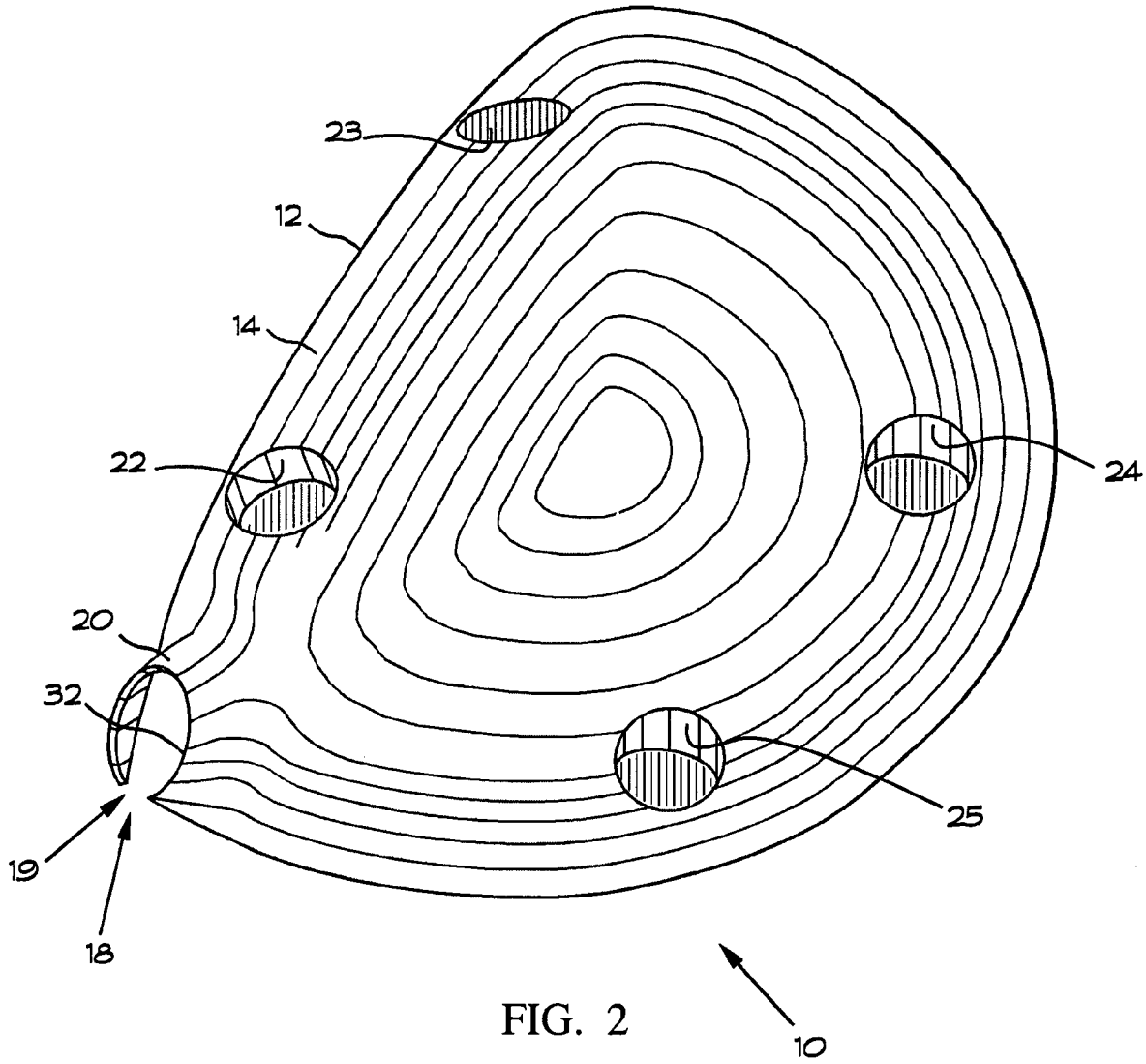
FIG. 2 is a perspective view showing the top side of the golf club head protective cap of FIG. 1.

As seen in the top plan view of FIG. 1, the top perspective view of FIG. 2 and FIGS. 4 and 5, the golf club head protective cap 10 includes a plurality of indentations 22-25. As shown in FIG. 3, these indentations in the upper surface 14 appear as projections in the bottom surface 16. The projections preferably are generally cylindrical in form and extend about 0.125 to 0.25 in. from the bottom surface 16. The outer ends of the projections are coated with an adhesive layer 28. The adhesive layers 28 preferably are covered by a removable paper or plastic cover layer 30 before the golf club head protective cap 10 is mounted to the golf club head 15. The cover layer 30 is manually removed, and the golf club head protective cap 10 is placed on the golf club head 15 with the club shaft 17 extending through the opening 18. The adhesive layers 28 adhere to upper portion of the golf club head 15 and cooperate with the edge 32 of the opening 18 to retain the golf club head protective cap 10 upon the golf club head 15. The golf club head protective cap 10 is easily removed from the golf club head 15 by manually grasping a portion of the flanged edge 13 and peeling the golf club head protective cap 10 away from the golf club head 15.

The structures and methods disclosed herein illustrate the principles of the present invention. The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention.

What is claimed is:

1. A protective cap configured for mounting to a golf club to protect the golf club head from damage, comprising:

a thin-walled shell having a convex outer surface and a concave inner surface, the thin-walled shell having an opening at an end portion thereof for receiving a shaft portion of the golf club with a portion of the golf club head being enclosed by the thin-walled shell; and a projection having an end extending away from the concave inner surface of the thin walled-shell; and an adhesive being applied to the end of the projection, the end being formed such that the adhesive contacts a portion of the golf club head when the shaft extends through the opening to retain the protective cap mounted to a selected portion of the golf club head.

2. The protective cap of claim 1 wherein the thin-walled shell includes a plurality of projections having ends with adhesive portions arranged to contact the golf club head.

* * * * *